US010510506B1

(12) United States Patent
Fasano

(10) Patent No.: US 10,510,506 B1
(45) Date of Patent: Dec. 17, 2019

(54) NARROW PROFILE CIRCUIT BREAKER WITH ARC INTERRUPTION

(71) Applicant: Carling Technologies, Inc., Plainville, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 16/263,195

(22) Filed: Jan. 31, 2019

(51) Int. Cl.

| | |
|---|---|
| ***H01H 71/50*** | (2006.01) |
| ***H01H 23/14*** | (2006.01) |
| ***H01H 83/22*** | (2006.01) |
| ***H01H 71/02*** | (2006.01) |
| ***H01H 73/04*** | (2006.01) |

(52) U.S. Cl.
CPC ..... *H01H 71/0264* (2013.01); *H01H 23/14* (2013.01); *H01H 71/025* (2013.01); *H01H 71/50* (2013.01); *H01H 73/04* (2013.01); *H01H 83/226* (2013.01)

(58) Field of Classification Search
CPC .. H01H 71/0264; H01H 71/025; H01H 71/50; H01H 73/04
See application file for complete search history.

(56) References Cited

U.S. PATENT DOCUMENTS

| | | | | |
|---|---|---|---|---|
| 4,618,751 | A * | 10/1986 | Wehr | H01H 9/36 218/151 |
| 4,900,275 | A * | 2/1990 | Fasano | H02B 1/052 439/716 |
| 8,847,096 | B2 * | 9/2014 | Juds | H01H 9/443 218/34 |
| 9,552,951 | B2 * | 1/2017 | Douglass | H01H 89/04 |
| 9,947,499 | B2 * | 4/2018 | Lin | H01H 71/54 |
| 10,163,598 | B2 * | 12/2018 | Lee | H01H 33/08 |
| 2007/0034495 | A1 * | 2/2007 | Christmann | H01H 71/526 200/400 |
| 2013/0180956 | A1 * | 7/2013 | Fasano | H01H 33/20 218/148 |

* cited by examiner

*Primary Examiner* — Kyung S Lee
(74) *Attorney, Agent, or Firm* — Forge IP, PLLC

(57) ABSTRACT

A circuit breaker design allows for the circuit breaker to have an overall width (i.e., measured along the circuit breaker's exposed outwardly-facing surface of its housing) that is narrower than achievable with known typical configurations, while at the same time still providing robust arc interruption capabilities. This is achieved in large part by providing a specific orientation of a moveable contact arm assembly and/or by providing a specific configuration of a current path within the housing.

22 Claims, 4 Drawing Sheets

NARROW PROFILE CIRCUIT BREAKER WITH ARC INTERRUPTION

FIELD OF THE INVENTION

The invention relates to the field of circuit breakers. More specifically, the invention relates to a circuit breaker having an improved design that allows for a more compact, narrower circuit breaker as compared to typical circuit breaker designs.

BACKGROUND OF THE INVENTION

A circuit interrupter is an electrical component that can break an electrical circuit, interrupting the current. A basic example of a circuit interrupter is a switch, which generally consists of two electrical contacts in one of two states; either closed meaning the contacts are physically touching and electrical current passes from one contact to the other, or open, meaning the contacts are separated relative to each other, thereby preventing the flow of electrical current therebetween. A switch may be directly manipulated by a person as a control signal to a system, such as a computer keyboard button, or to control power flow in a circuit, such as a light switch.

A second example of a circuit interrupter is a circuit breaker. A circuit breaker is generally used in an electrical panel that monitors and limits the amount of current (amperage) being sent through the electrical wiring. A circuit breaker is designed to protect an electrical circuit from damage caused by an overload or a short circuit. If a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a line terminal and a load terminal. Generally, the line terminal is in electrical communication with a supply of incoming electricity, most often from a power company or generator. This can sometimes be referred to as the input into the circuit breaker. The load terminal, sometimes referred to as the output, feeds out of the circuit breaker and connects to the electrical components being fed from the circuit breaker. There may be an individual component connected directly to a circuit breaker, for example only an air conditioner, or a circuit breaker may be connected to multiple components through a power wire which terminates at electrical outlets.

A circuit breaker can be used as a replacement for a fuse. Unlike a fuse, which operates once and then has to be replaced, a circuit breaker can be reset (either manually or automatically) to resume normal operation. Fuses perform much the same duty as circuit breakers, however, circuit breakers are safer to use than fuses and easier to fix. If a fuse blows, oftentimes a person will not know which fuse controls which specific power areas. The person will have to examine the fuses to determine which fuse appears to be burned or spent. The fuse will then have to be removed from the fuse box and a new fuse will have to be installed.

Circuit breakers are much easier to fix than fuses. When a circuit breaker trips, one can easily look at the electrical panel and see which breaker actuator has moved to the tripped position. The circuit breaker can then be "reset" in many cases by turning the actuator to the "off" position, and then moving the actuator to the "on" position.

In general, a circuit breaker has two contacts located inside of a housing. The first contact is typically stationary, and may be connected to either the line terminal or the load terminal (often, the line terminal). The second contact is typically movable with respect to the first contact, such that when the circuit breaker is in the "off", or tripped position, a physical gap exists between the first and second contacts. The second contact may be connected to whichever of the line terminal or the load terminal that the first contact is not connected to (often, the second contact is connected to the load terminal).

To trip the circuit breaker so as to open the circuit, an overcurrent sensor may be provided (such as, for example, a hydraulic magnetic overcurrent sensor or a thermal overcurrent sensor) or a solenoid type trip mechanism with an overcurrent sensor may be used. When the overcurrent sensor senses a current level above a threshold level, which may, for example, be a percentage above the rated current of the circuit breaker, the overcurrent sensor or solenoid may be actuated to mechanically move the second contact away from the first contact, thereby tripping the circuit breaker to open the circuit.

A problem with a traditional circuit interrupter, however, is that even though it may be in the open position, i.e. a switch is open or a circuit breaker has tripped, interrupting the connection, the open area between the first and second contact allows an electrical arc to form between the two contacts, particularly right as the contacts are opening, or just prior to their closing. The electrical arc may have a high voltage and/or amperage, and as such can be dangerous; they can cause damage to the circuit interrupter, specifically damaging the electrical contacts, linkages or other moveable components. Any damage to the electrical contacts or other components shortens the lifespan of the circuit interrupter and affects its performance.

Another effect of arcing stems from the extremely high temperature of the arc (perhaps tens of thousands of degrees Celsius), which can impact the surrounding gas molecules creating ozone, carbon monoxide, and other dangerous compounds. The arc can also ionize surrounding gasses, potentially creating alternate conduction paths.

Because of these detrimental effects, it has been recognized to be very important to quickly cool and quench the arc in order to prevent damage to the circuit interrupter and/or to limit the above-described dangerous situations.

There have been many proposed devices to quickly quench an arc. One of such common devices comprises an arc splitter stack into with or without arc straps. While such arc splitter stacks often provide the circuit breaker with acceptable arc quenching properties, the advantage comes with several costs, one of them being an increase in required space. By their very nature (i.e., being defined by a series of plates that must be separated by air gaps), arc splitter stacks require significant space within the circuit breaker housing.

This may present potential issues in certain situations. More specifically, as electrical components in general get smaller and smaller, tenths of an inch become more important and, therefore, any shrinking of the dimensions of a circuit breaker is desired. In some situations, it is the depth of the circuit breaker that is an issue, and various low profile designs have been proposed to address these depth concerns. In other situations, however, it may be the width of the circuit breaker (i.e., measured along the circuit breaker's exposed mounting surface) that is important. The present invention is specifically intended to address this situation.

It is therefore desired to provide a circuit breaker design that allows for the circuit breaker to have an overall width (i.e., measured along the circuit breaker's exposed outwardly-facing surface) that is narrower than achievable with known typical configurations, while at the same time still providing robust arc interruption capabilities.

SUMMARY OF THE INVENTION

To this end, a circuit breaker is provided according to one aspect of the present invention comprising a housing within which components of the circuit breaker are disposed, the housing having an outwardly facing exposed surface, a line terminal adapted to be electrically connected to a source of electrical power, and a load terminal adapted to be electrically connected to at least one load. A stationary contact is positioned within the housing, and a moveable contact arm assembly is provided having a generally longitudinal axis and a moveable contact positioned thereon, the moveable contact arm assembly being moveable between a closed position in which the moveable contact and the stationary contact are in physical contact and the line terminal and the load terminal are in electrical communication via at least the moveable contact, the stationary contact and a conductive strap, and an open position in which the moveable contact and the stationary contact are out of physical contact and the line terminal and the load terminal are out of electrical communication. An overcurrent tripping device is operably coupled to the moveable contact arm assembly via a linkage assembly and is adapted to move the moveable contact arm assembly to the open position upon detection of an overcurrent situation. A resetting mechanism is provided, actuation of which is adapted to, when the moveable contact arm assembly is in the open position, move the moveable contact arm assembly to the closed position, the resetting mechanism extending from, or being accessible through, the outwardly facing exposed surface of the housing. An arc splitter is adapted to quench an arc created between the stationary contact and the moveable contact as the stationary contact and the moveable contact are moveable into and/or out of contact with one another. The outwardly facing exposed surface of the housing generally defines an exposed surface plane, and the longitudinal axis of the moveable contact arm assembly is generally orthogonal with respect to the exposed surface plane when the moveable contact arm assembly is in the closed position. The conductive strap lies in a conductive strap plane, wherein the moveable contact arm assembly moves in a contact arm plane as it moves between the open and the closed position, and wherein the conductive strap plane and the contact arm plane are parallel to, but spaced apart from, one another.

In some embodiments, the conductive strap plane and the contact arm plane are both generally orthogonal with respect to the exposed surface plane. In some embodiments, an imaginary plane exists that is parallel to the exposed surface plane and that passes through the moveable contact arm assembly and the conductive strap. In certain of these embodiments, the imaginary plane also passes through the moveable contact and the stationary contact.

In some embodiments, surfaces of the stationary contact and the moveable contact that physically contact each other both face in directions generally parallel to the exposed surface plane.

In some embodiments, a width of the outwardly facing exposed surface taken parallel to the contact arm plane is less than 2 inches. In certain of these embodiments, the width of the outwardly facing exposed surface taken parallel to the contact arm plane is less than 1.75 inches. In certain of these embodiments, the width of the outwardly facing exposed surface taken parallel to the contact arm plane is less than 1.575 inches.

In some embodiments, actuation of the resetting mechanism is further adapted to manually move the moveable contact arm assembly between the open position and the closed position. In certain of these embodiments, the resetting mechanism comprises a handle having a portion thereof extending from the housing adapted to be actuated by a user. In certain embodiments, the resetting mechanism comprises a rocker mechanism having a portion thereof extending from the housing adapted to be actuated by a user.

In some embodiments, the arc splitter comprises a plurality of spaced apart conductive plates disposed within the housing. In some embodiments, the line terminal and the load terminal are disposed on a surface of the housing that is generally parallel to, and spaced apart from, the outwardly facing exposed surface.

In accordance with another aspect of the present invention, a circuit breaker comprises a housing within which components of the circuit breaker are disposed, the housing having an outwardly facing exposed surface, a line terminal adapted to be electrically connected to a source of electrical power, and a load terminal adapted to be electrically connected to at least one load. The circuit breaker also comprises a stationary contact positioned within the housing, and a moveable contact arm assembly having a generally longitudinal axis and a moveable contact positioned thereon, the moveable contact arm assembly being moveable between a closed position in which the moveable contact and the stationary contact are in physical contact and the line terminal and the load terminal are in electrical communication, and an open position in which the moveable contact and the stationary contact are out of physical contact and the line terminal and the load terminal are out of electrical communication. An overcurrent tripping device is operably coupled to the moveable contact arm assembly via a linkage assembly and is adapted to move the moveable contact arm assembly to the open position upon detection of an overcurrent situation. A resetting mechanism is provided, actuation of which is adapted to, when the moveable contact arm assembly is in the open position, move the moveable contact arm assembly to the closed position, the resetting mechanism extending from, or being accessible through, the outwardly facing exposed surface of the housing. An arc splitter is adapted to quench an arc created between the stationary contact and the moveable contact as the stationary contact and the moveable contact are moveable into and/or out of contact with one another. The outwardly facing exposed surface of the housing generally defines an exposed surface plane, and the longitudinal axis of the moveable contact arm assembly is generally orthogonal with respect to the exposed surface plane when the moveable contact arm assembly is in the closed position. Surfaces of the stationary contact and the moveable contact that physically contact each other both face in directions generally parallel to the exposed surface plane.

In some embodiments, when the moveable contact arm assembly is in the closed position and the moveable contact and the stationary contact are in physical contact, the line terminal and the load terminal are in electrical communication via at least the moveable contact, the stationary contact and a conductive strap, the conductive strap lies in a conductive strap plane, the moveable contact arm assembly moves in a contact arm plane as it moves between the open and the closed position, and the conductive strap plane and the contact arm plane are parallel to, but spaced apart from, one another.

In some embodiments, the conductive strap plane and the contact arm plane are both generally orthogonal with respect to the exposed surface plane. In certain of these embodiments, an imaginary plane exists that is parallel to the exposed surface plane and that passes through the moveable contact arm assembly and the conductive strap. In certain of these embodiments, the imaginary plane also passes through the moveable contact and the stationary contact.

In accordance with a further aspect of the present invention, a circuit breaker comprises a housing within which components of the circuit breaker are disposed, the housing having an outwardly facing exposed surface, a line terminal adapted to be electrically connected to a source of electrical power, and a load terminal adapted to be electrically connected to at least one load. Also provided are a stationary contact positioned within the housing, and a moveable contact arm assembly having a moveable contact positioned thereon, the moveable contact arm assembly being moveable between a closed position in which the moveable contact and the stationary contact are in physical contact and the line terminal and the load terminal are in electrical communication via at least the moveable contact, the stationary contact and a conductive strap, and an open position in which the moveable contact and the stationary contact are out of physical contact and the line terminal and the load terminal are out of electrical communication. An overcurrent tripping device is operably coupled to the moveable contact arm assembly via a linkage assembly and is adapted to move the moveable contact arm assembly to the open position upon detection of an overcurrent situation. A resetting mechanism is provided, actuation of which is adapted to, when the moveable contact arm assembly is in the open position, move the moveable contact arm assembly to the closed position, the resetting mechanism extending from, or being accessible through, the outwardly facing exposed surface of the housing. An arc splitter is adapted to quench an arc created between the stationary contact and the moveable contact as the stationary contact and the moveable contact are moveable into and/or out of contact with one another. The conductive strap lies in a conductive strap plane, the moveable contact arm assembly moves in a contact arm plane as it moves between the open and the closed position, and the conductive strap plane and the contact arm plane are parallel to, but spaced apart from, one another. The outwardly facing exposed surface of the housing generally defines an exposed surface plane, the conductive strap plane and the contact arm plane are both generally orthogonal with respect to the exposed surface plane, and an imaginary plane exists that is parallel to the exposed surface plane and that passes through the moveable contact arm assembly and the conductive strap.

In some embodiments, the imaginary plane also passes through the moveable contact and the stationary contact. In certain of these embodiments, surfaces of the stationary contact and the moveable contact that physically contact each other both face in directions generally parallel to the exposed surface plane.

In some embodiments, the moveable contact arm assembly has a generally longitudinal axis that is generally orthogonal with respect to the exposed surface plane when the moveable contact arm assembly is in the closed position.

The present invention thus provides a circuit breaker design that allows for the circuit breaker to have an overall width (i.e., measured along the circuit breaker's exposed outwardly-facing surface) that is narrower than achievable with known typical configurations, while at the same time still providing robust arc interruption capabilities.

Other objects of the invention and its particular features and advantages will become more apparent from consideration of the following drawings and accompanying detailed description.

DETAILED DESCRIPTION OF THE INVENTION

Figure 1:
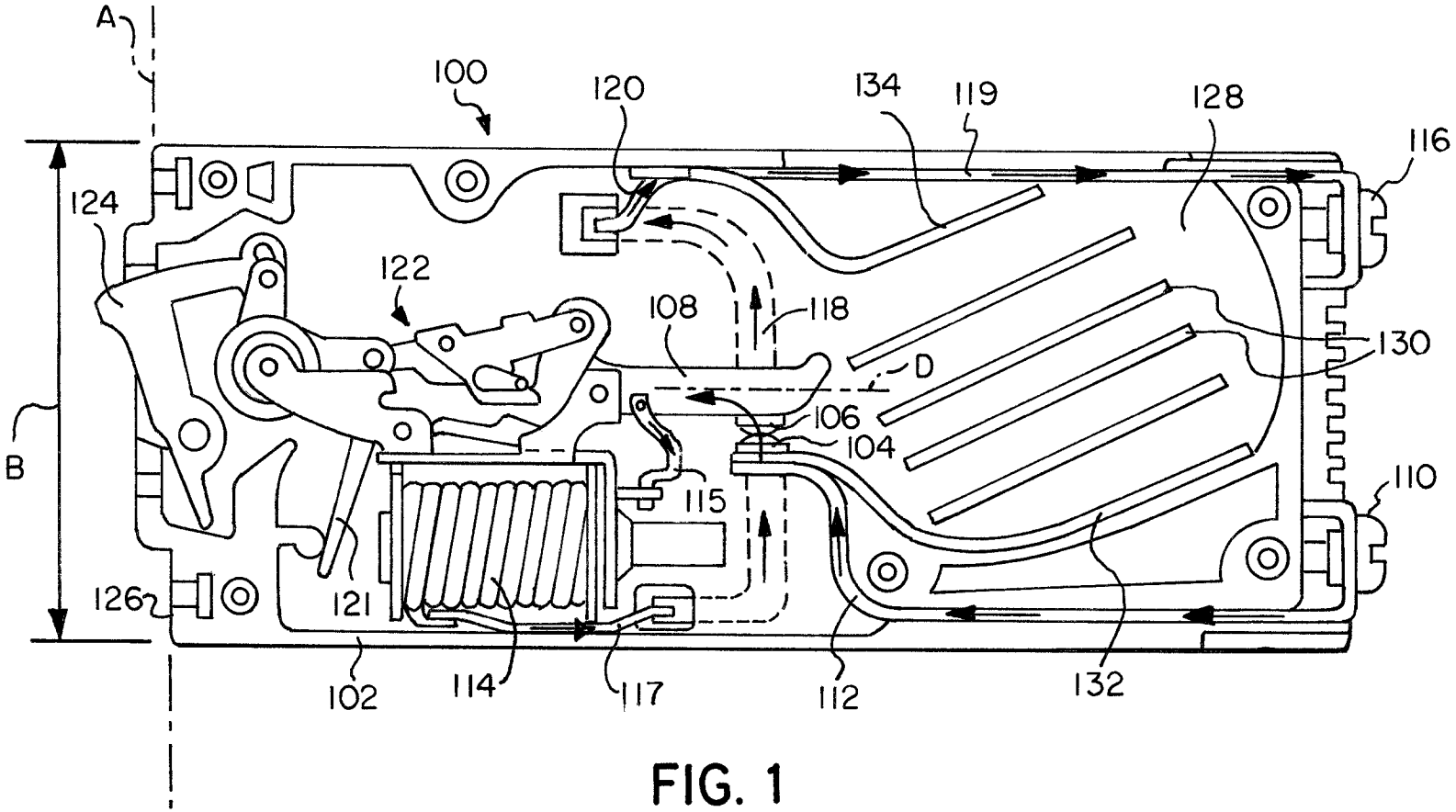
FIG. 1 is a side elevational view, partially broken away, illustrating an exemplary circuit breaker constructed in accordance with the present invention.

Referring now to the drawings, wherein like reference numerals designate corresponding structure throughout the views.

FIG. 1 illustrates components of an example circuit breaker (100) having an improved design that allows for the circuit breaker (100) to have an overall width (i.e., measured along the circuit breaker's exposed outwardly facing surface) that is narrower than permitted with known typical configurations, while at the same time still providing robust arc interruption capabilities.

Figure 4:
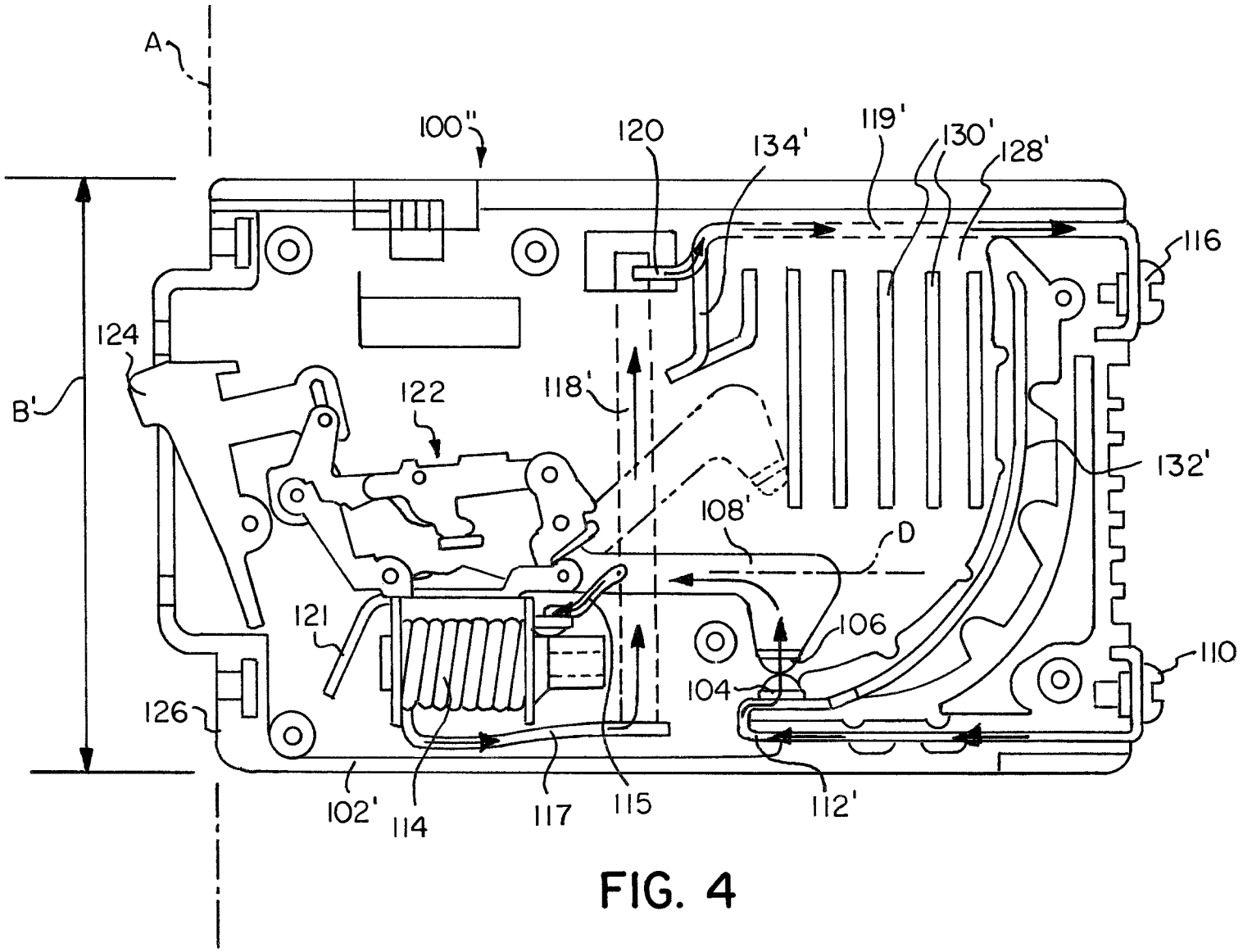
FIG. 4 is a side elevational view, partially broken away, illustrating another exemplary circuit breaker constructed in accordance with the present invention.

Circuit breaker (100) is provided with a housing (102) that contains the working elements of the device. The circuit breaker (100) is further provided with a set of contacts including a stationary contact (104) and movable contact (106). The moveable contact (106) is positioned on a moveable contact arm assembly (108), and the moveable contact (106) is configured to move between an open and closed position relative to the stationary contact (104). FIG. 1 shows the contacts (104, 106) in the closed position where electrical current flows therebetween, whereas FIG. 4 shows the contacts (104, 106) both in the closed position (represented by solid lines) where electrical current flows therebetween and an open position (represented by dashed lines) where no electrical current flows therebetween.

Also shown in FIG. 1 is a "line" terminal (110), which is designed to be connected to a source of electrical power (not shown), such as a bus bar in a panel board or load center. Stationary contact (104) is mounted onto a first conductive element (112), which in turn is electrically connected to line terminal (110).

Also provided is a "load" terminal (116), which is designed to be connected to the electrical components (not shown) being fed from the circuit breaker, such as an individual component connected directly to a circuit breaker (e.g., an air conditioner unit), or multiple components through a power wire which terminates at electrical outlets.

Moveable contact (106) mounted on moveable contact arm assembly (108) is in indirect electrical communication with the load terminal (116). More specifically, the moveable contact arm assembly (108), which is electrically conductive, is in electrical communication with an input side of an overcurrent tripping device (114) through a conductive connector (115). An output side of the overcurrent tripping device (114) is in electrical communication with a conductive strap (118) through a conductive connector (117), with the conductive strap (118) being in electrical communication, via another conductive connector (120) with a second conductive element (119), on which the load terminal (116) is mounted.

In operation, and when the circuit breaker is in the "on" state (i.e., when the stationary contact (104) and the moveable contact (106) are closed and thereby in electrical communication), electrical power is input into circuit breaker (100) via line terminal (110) and exits the circuit breaker (100) vis the load terminal (116). The flow of electricity through the circuit breaker (indicated by arrows in FIG. 1) will now be discussed.

As indicated, electrical power flows into the circuit breaker (100) through line terminal (110), and then passes through first conductive element (112) to stationary contact (104). The contacts being closed, the electrical power flows through moveable contact (106), through conductive contact arm assembly (108), through conductive connector (115) and to the input side of an overcurrent tripping device (114). The electrical power then flows out the output side of the overcurrent tripping device (114) through conductive connector (117), through conductive strap (118) and then through conductive connector (120) and conductive element (119), exiting the circuit breaker through load terminal (116).

If the electrical current exceeds a threshold level, overcurrent tripping device (114) will function to "trip" the circuit breaker (100) by opening the circuit (opening the contacts relative to each other by means of a trip mechanism (121) and linkage assembly (122) such that the flow of electrical current through the contacts (104,106) ceases. In the event that the electrical current does not exceed the threshold level set by overcurrent tripping device (114), the electrical power is allowed to pass through load terminal (116), which in turn, provides electrical power to the connected circuit and/or equipment.

The circuit breaker (100) also includes a resetting mechanism (124) adapted to reset the circuit breaker (100) and move the moveable contact (106) into physical contact with the stationary contact (104) by movement of the moveable contact arm assembly (108). The resetting mechanism (124) is connected to the linkage assembly (122), which in turn, is connected to the moveable contact arm assembly (108) for this purpose. The resetting mechanism (124) may also be used to manually open and close the contacts (104,106), i.e., to turn the circuit breaker (100) on and off, as is known in the art.

In the exemplary embodiment shown in FIG. 1 the resetting mechanism (124) takes the form of a low profile rocker-type actuator, and the linkage assembly (122) is particularly adapted to work in conjunction with this type of low profile rocker-type actuator resetting mechanism (124). The particular configuration of this type of resetting mechanism (124) and linkage assembly (122) forms a large part of the subject matter to which is directed U.S. Pat. No. 9,947,499, which is assigned to the assignee of the present application. As such, a detailed description thereof is not repeated herein. Instead, the entire contents of U.S. Pat. No. 9,947,499 are hereby incorporated herein in their entirety.

Figure 3:
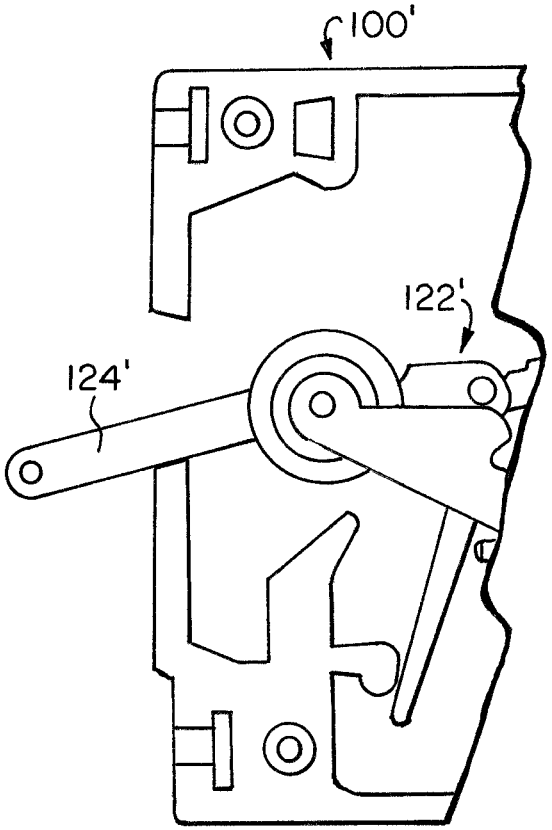
FIG. 3 is a side elevational view, partially broken away, illustrating a portion of the exemplary circuit breaker constructed in accordance with the present invention as shown in FIG. 1, but where the rocker-type actuator has been replaced with a handle-type actuator.

It should be noted, however, that the resetting mechanism and/or the linkage assembly may take other forms. For example, referring now to FIG. 3, the resetting mechanism (124') of the shown exemplary circuit breaker (100') takes the form of a traditional handle-type actuator, and the linkage assembly (122') is particularly adapted to work in conjunction with this type of handle-type actuator resetting mechanism (124'). As such handle-type resetting mechanisms (124') and corresponding linkage assemblies (122') are well known in the art, further details thereof are not provided herein.

Referring again specifically to FIG. 1, the circuit breaker (100) is shown in the "on" position, where the contacts (104,106) are closed. As is known, when the circuit breaker (100) is manually turned off or when an overcurrent situation is sensed, the contacts (104,106) are caused to open, to thereby cease the flow of electrical power through the circuit breaker (100). However, also as is known, although moveable contact (106) has separated from stationary contact (104), electricity, in the form of an arc (not shown) may still flow from electrical contact (104) to electrical contact (106). The arc may be capable of jumping between electrical contacts, through air, and can cause severe damage to both contacts (104,106). In a worst case scenario, a single arc can damage the contacts so severely as to render them inoperable during normal operation. To protect electrical contacts (104,106), and circuit breaker (100) overall, any created arc must be extinguished as quickly as possible. This is done by pushing the arc into an arc splitter disposed within an arc chamber (128).

The arc splitter may take the form of a plurality of spaced apart, generally metallic, plates (130) which draw the arc in, and cool and quench the arc. Each plate (130) may be spaced apart at the same distance, or the distance between each plate (130) may vary depending on the application of circuit breaker. For example, each plate (130) may be spaced apart approximately 0.8 inches from the next plate, or the distance between each plate (130) may be varied. For example, the plates toward one side of the housing may be closer together than the plates towards the other side of the housing, or vice versa.

Additionally, one or more arc straps (132,134) may be provided in order to provide a safe place for the arc to jump prior to the arc being fully extinguished. In the shown example, a first arc strap (132) is in electrical communication with the line terminal (110), while a second arc strap (134) is in electrical communication with the load terminal (116).

The housing (102) of the circuit breaker (100) includes an outwardly facing exposed surface (126) through which the resetting mechanism (124) extends and/or is accessible by a user. As will be understood by those skilled in the art, circuit breakers of the type discussed herein are configured to be inserted into panels with a plurality of other circuit breaker (at least some of which are typically identical to others). A typical home, for example, has at least one, and perhaps two, three or even more, such panels, each of which may include 10, 20 or even more circuit breakers. Also as is understood by those skilled in the art, generally only one surface of each of the circuit breakers (i.e., the one carrying the resetting mechanism) is exposed. This outwardly facing exposed surface (shown as 126 in FIG. 1) generally defines a plane (shown as A in FIG. 1). Typically, all of the circuit breakers disposed in each panel their outwardly facing exposed surface lying in the same plane (A).

Figure 2:
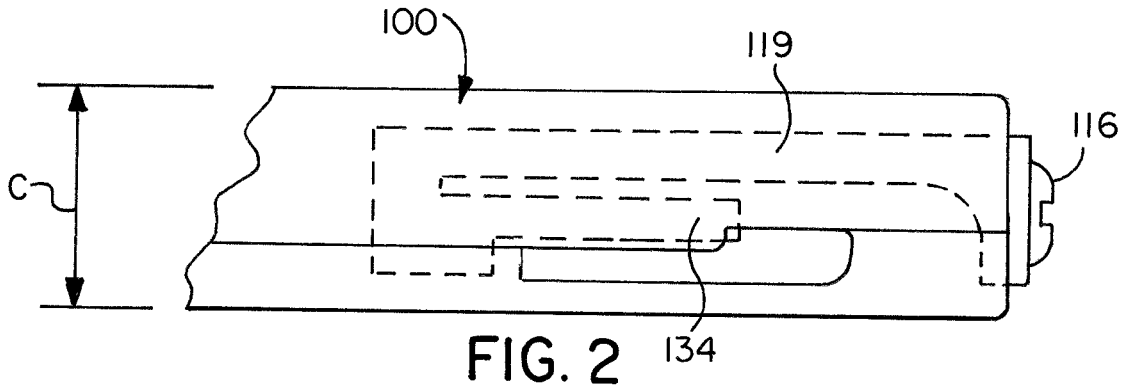
FIG. 2 is a top plan view illustrating a portion of the exemplary circuit breaker constructed in accordance with the present invention as shown in FIG. 1.

As discussed, one of the objects of the present invention is to provide a circuit breaker design having a width (B), which is narrower than is typically achievable in circuit breakers of the type disclosed. By width (B), what is meant is the dimension of the outwardly facing exposed surface (126) taken parallel to a plane in which the moveable contact arm assembly (108) moves as it opens and closes. This is as opposed to the height (C) of the circuit breaker (shown in FIG. 2), which corresponds to the dimension of the outwardly facing exposed surface (126) taken perpendicular to a plane in which the moveable contact arm assembly (108) moves as it opens and closes. While the height (C) may be of particular concern in the context of some circuit breakers, it is the width (B) of the circuit breaker (100) that is of particular concern here.

Incidentally, the reason that the terms "width" and "height" are used herein is because the circuit breakers are typically disposed in panels such that the line terminal (110) and the load terminal (116) are disposed generally horizontally, with multiple circuit breakers being stacked one on top of another such that the line terminals (110) of the stacked circuit breakers are generally vertically aligned and the load terminals (116) of the stacked circuit breakers are generally vertically aligned. With respect to the embodiment shown in FIG. 3, this would mean that the handle-type actuator resetting mechanism (124') would be moveable horizontally left-to-right and right-to-left when facing the panel of circuit breakers. Typically, a panel for residential use includes two stacks of circuit breakers.

Preferably, the width (B) of the outwardly facing exposed surface (126) is less than 2 inches, and more preferably less than 1.75 inches. As but an illustrative example, the width (B) of the outwardly facing exposed surface (126) of circuit breaker (100) may be about 1.570 inches, while the height (C) (shown in FIG. 2), may be about 0.75 inches. In this embodiment, the depth of the circuit breaker (100)—i.e., the dimension between the outwardly facing exposed surface (126) and the terminals (110,116)—may be about 3.0 inches. It should be noted that while this depth may be greater than typical circuit breakers (and is certainly greater than low profile circuit breakers particularly configured to reduce depth), the circuit breaker (100) of the present invention is particularly concerned with providing reduced width (B), not necessarily depth.

Ways in which the reduced width (B) of circuit breaker (100) can be achieved in accordance with the present invention will now be discussed.

Again referring to FIG. 1, it will be noted that when the circuit breaker (100) is in the "on" position, such that the contacts (104,106) are closed, a longitudinal axis (D) of the moveable contact arm assembly (108) is generally orthogonal with respect to the plane (A) defined by the outwardly facing exposed surface (126). Stated another way, the faces of the contacts (104,106) that make contact with each other both face in directions generally parallel to the plane (A) defined by the outwardly facing exposed surface (126).

This is in contrast with typical circuit breaker designs where the moveable contact arm assembly is generally parallel with respect to the plane defined by the outwardly facing exposed surface (i.e., where the faces of the contacts that make contact with each other both face in directions generally orthogonal to the plane defined by the outwardly facing exposed surface), as can be seen, for example, in U.S. Pat. No. 9,947,499, or where the moveable contact arm assembly is disposed at an acute or obtuse angle with respect to the plane defined by the outwardly facing exposed surface (i.e., where the faces of the contacts that make contact with each other both face in directions generally defining acute or obtuse angles with respect to the plane defined by the outwardly facing exposed surface), as may be the case with other low profile circuit breaker designs.

Still referring to FIG. 1, the particular configuration of the conductive strap (118), and particularly its relationship with the moveable contact arm assembly (108) and contacts (104,106) is also important in connection with allowing for the reduced width (B) of circuit breaker (100) to be achieved.

More specifically, as can be clearly seen with respect to the orientation illustrated in FIG. 1, the conductive strap (118) passes behind, and if offset from, the moveable contact arm assembly (108) and contacts (104,106). More generally speaking, the conductive strap (118) can be considered to lie in a plane, while the moveable contact arm assembly (108) can be considered to open/close in a different plane, with these two planes being parallel to, but spaced apart from one another by a distance. It should further be noted that both of these planes are generally orthogonal with respect to the plane (A) defined by the outwardly facing exposed surface (126).

In the specific example shown in FIG. 1, it can further be the that an imaginary plane exists that is parallel to the plane (A) defined by the outwardly facing exposed surface (126), and that passes through all four of the conductive strap (118), the moveable contact arm assembly (108), the moveable contact (106) and the stationary contact (104).

However, this particular relationship need not be true in all embodiments. For example, referring to the circuit breaker (100") embodiment shown in FIGS. 4 and 5, in this embodiment, it can indeed be the that the conductive strap (118') can be considered to lie in a plane, while the moveable contact arm assembly (108') can be considered to open/close in a different plane, with these two planes being parallel to, but spaced apart from one another by a distance. It can indeed further be the that both of these planes are generally orthogonal with respect to the plane (A) defined by the outwardly facing exposed surface (126). However, in this particular embodiment there is no imaginary plane that is parallel to the plane (A) defined by the outwardly facing exposed surface (126), and that passes through all four of the conductive strap (118'), the moveable contact arm assembly (108'), the moveable contact (106) and the stationary contact (104). Although, there is, even in this embodiment, an imaginary plane that is parallel to the plane (A) defined by the outwardly facing exposed surface (126), and that passes through both of the conductive strap (118') and the moveable contact arm assembly (108').

Figure 5:
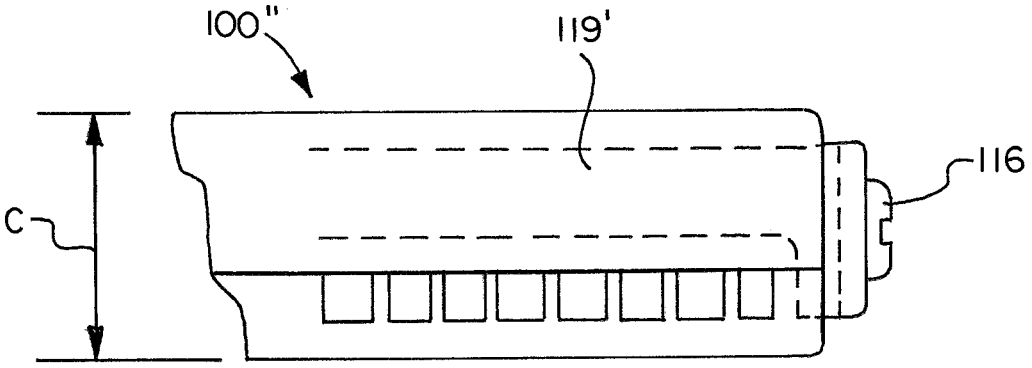
FIG. 5 is a top plan view illustrating a portion of the exemplary circuit breaker constructed in accordance with the present invention as shown in FIG. 4.

In other respects, the embodiment of FIGS. 4 and 5 is similar to those previously discussed, though various minor differences will be noted in various components, such as housing (102'), first conductive element (112'), conductive element (119'), arc chamber (128'), arc plates (130'), and arc straps (132',134'). While these differences do not materially affect operation of the circuit breaker (100"), they may result in slightly different dimensions, with circuit breaker (100"), for example, having a width (B') of about 1.575 inches, a height (C') of about 0.75 inches and a depth (i.e., the dimension between the outwardly facing exposed surface (126) and the terminals (110,116)) of about 2.625 inches.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit breaker comprising:

a housing within which components of the circuit breaker are disposed, the housing having an outwardly facing exposed surface;

a line terminal adapted to be electrically connected to a source of electrical power;

a load terminal adapted to be electrically connected to at least one load;

a stationary contact positioned within the housing;

a moveable contact arm assembly having a generally longitudinal axis and a moveable contact positioned thereon, the moveable contact arm assembly being moveable between a closed position in which the moveable contact and the stationary contact are in physical contact and the line terminal and the load terminal are in electrical communication via at least the moveable contact, the stationary contact and a conductive strap, and an open position in which the moveable contact and the stationary contact are out of physical contact and the line terminal and the load terminal are out of electrical communication;

an overcurrent tripping device operably coupled to the moveable contact arm assembly via a linkage assembly and adapted to move the moveable contact arm assembly to the open position upon detection of an overcurrent situation;

a resetting mechanism, actuation of which is adapted to, when the moveable contact arm assembly is in the open position, move the moveable contact arm assembly to the closed position, the resetting mechanism extending from, or being accessible through, the outwardly facing exposed surface of the housing; and an arc splitter adapted to quench an arc created between the stationary contact and the moveable contact as the stationary contact and the moveable contact are moveable into and/or out of contact with one another;

wherein the outwardly facing exposed surface of the housing generally defines an exposed surface plane, and wherein the longitudinal axis of the moveable contact arm assembly is generally orthogonal with respect to the exposed surface plane when the moveable contact arm assembly is in the closed position; and wherein the conductive strap lies in a conductive strap plane, wherein the moveable contact arm assembly moves in a contact arm plane as it moves between the open and the closed position, and wherein the conductive strap plane and the contact arm plane are parallel to, but spaced apart from, one another.

2. The circuit breaker of claim 1 wherein the conductive strap plane and the contact arm plane are both generally orthogonal with respect to the exposed surface plane.

3. The circuit breaker of claim 1 wherein an imaginary plane exists that is parallel to the exposed surface plane and that passes through the moveable contact arm assembly and the conductive strap.

4. The circuit breaker of claim 3 wherein the imaginary plane also passes through the moveable contact and the stationary contact.

5. The circuit breaker of claim 1 wherein surfaces of the stationary contact and the moveable contact that physically contact each other both face in directions generally parallel to the exposed surface plane.

6. The circuit breaker of claim 1 wherein a width of the outwardly facing exposed surface taken parallel to the contact arm plane is less than 2 inches.

7. The circuit breaker of claim 6 wherein the width of the outwardly facing exposed surface taken parallel to the contact arm plane is less than 1.75 inches.

8. The circuit breaker of claim 7 wherein the width of the outwardly facing exposed surface taken parallel to the contact arm plane is less than 1.575 inches.

9. The circuit breaker of claim 1 wherein actuation of the resetting mechanism is further adapted to manually move the moveable contact arm assembly between the open position and the closed position.

10. The circuit breaker of claim 9, wherein the resetting mechanism comprises a handle having a portion thereof extending from the housing adapted to be actuated by a user.

11. The circuit breaker of claim 9, wherein the resetting mechanism comprises a rocker mechanism having a portion thereof extending from the housing adapted to be actuated by a user.

12. The circuit breaker of claim 1 wherein the arc splitter comprises a plurality of spaced apart conductive plates disposed within the housing.

13. The circuit breaker of claim 1 wherein the line terminal and the load terminal are disposed on a surface of the housing that is generally parallel to, and spaced apart from, the outwardly facing exposed surface.

14. A circuit breaker comprising:

a housing within which components of the circuit breaker are disposed, the housing having an outwardly facing exposed surface;

a line terminal adapted to be electrically connected to a source of electrical power;

a load terminal adapted to be electrically connected to at least one load;

a stationary contact positioned within the housing;

a moveable contact arm assembly having a generally longitudinal axis and a moveable contact positioned thereon, the moveable contact arm assembly being moveable between a closed position in which the moveable contact and the stationary contact are in physical contact and the line terminal and the load terminal are in electrical communication, and an open position in which the moveable contact and the stationary contact are out of physical contact and the line terminal and the load terminal are out of electrical communication;

an overcurrent tripping device operably coupled to the moveable contact arm assembly via a linkage assembly and adapted to move the moveable contact arm assembly to the open position upon detection of an overcurrent situation;

a resetting mechanism, actuation of which is adapted to, when the moveable contact arm assembly is in the open position, move the moveable contact arm assembly to the closed position, the resetting mechanism extending from, or being accessible through, the outwardly facing exposed surface of the housing; and an arc splitter adapted to quench an arc created between the stationary contact and the moveable contact as the stationary contact and the moveable contact are moveable into and/or out of contact with one another;

wherein the outwardly facing exposed surface of the housing generally defines an exposed surface plane, and wherein the longitudinal axis of the moveable contact arm assembly is generally orthogonal with respect to the exposed surface plane when the moveable contact arm assembly is in the closed position; and wherein surfaces of the stationary contact and the moveable contact that physically contact each other both face in directions generally parallel to the exposed surface plane.

15. The circuit breaker of claim 14 wherein:

when the moveable contact arm assembly is in the closed position and the moveable contact and the stationary contact are in physical contact, the line terminal and the load terminal are in electrical communication via at least the moveable contact, the stationary contact and a conductive strap; and wherein the conductive strap lies in a conductive strap plane, wherein the moveable contact arm assembly moves in a contact arm plane as it moves between the open and the closed position, and wherein the conductive strap plane and the contact arm plane are parallel to, but spaced apart from, one another.

16. The circuit breaker of claim 15 wherein the conductive strap plane and the contact arm plane are both generally orthogonal with respect to the exposed surface plane.

17. The circuit breaker of claim 16 wherein an imaginary plane exists that is parallel to the exposed surface plane and that passes through the moveable contact arm assembly and the conductive strap.

18. The circuit breaker of claim 17 wherein the imaginary plane also passes through the moveable contact and the stationary contact.

19. A circuit breaker comprising:

a housing within which components of the circuit breaker are disposed, the housing having an outwardly facing exposed surface;

a line terminal adapted to be electrically connected to a source of electrical power;

a load terminal adapted to be electrically connected to at least one load;

a stationary contact positioned within the housing;

a moveable contact arm assembly having a moveable contact positioned thereon, the moveable contact arm assembly being moveable between a closed position in which the moveable contact and the stationary contact are in physical contact and the line terminal and the load terminal are in electrical communication via at least the moveable contact, the stationary contact and a conductive strap, and an open position in which the moveable contact and the stationary contact are out of physical contact and the line terminal and the load terminal are out of electrical communication;

an overcurrent tripping device operably coupled to the moveable contact arm assembly via a linkage assembly and adapted to move the moveable contact arm assembly to the open position upon detection of an overcurrent situation;

a resetting mechanism, actuation of which is adapted to, when the moveable contact arm assembly is in the open position, move the moveable contact arm assembly to the closed position, the resetting mechanism extending from, or being accessible through, the outwardly facing exposed surface of the housing; and an arc splitter adapted to quench an arc created between the stationary contact and the moveable contact as the stationary contact and the moveable contact are moveable into and/or out of contact with one another;

wherein the conductive strap lies in a conductive strap plane, wherein the moveable contact arm assembly moves in a contact arm plane as it moves between the open and the closed position, and wherein the conductive strap plane and the contact arm plane are parallel to, but spaced apart from, one another;

wherein the outwardly facing exposed surface of the housing generally defines an exposed surface plane;

wherein the conductive strap plane and the contact arm plane are both generally orthogonal with respect to the exposed surface plane; and wherein an imaginary plane exists that is parallel to the exposed surface plane and that passes through the moveable contact arm assembly and the conductive strap.

20. The circuit breaker of claim 19 wherein the imaginary plane also passes through the moveable contact and the stationary contact.

21. The circuit breaker of claim 20 wherein surfaces of the stationary contact and the moveable contact that physically contact each other both face in directions generally parallel to the exposed surface plane.

22. The circuit breaker of claim 19 wherein the moveable contact arm assembly has a generally longitudinal axis that is generally orthogonal with respect to the exposed surface plane when the moveable contact arm assembly is in the closed position.

* * * * *